US011333158B2

(12) United States Patent
Lehr et al.

(10) Patent No.: US 11,333,158 B2
(45) Date of Patent: May 17, 2022

(54) RADIAL BLOWER

(71) Applicant: TEQTONIQ GmbH, Horw (CH)

(72) Inventors: Andreas Lehr, Edlibach (CH); Michael Bütikofer, Affoltem am Albis (CH); David Muri, Kriens (CH); Markus Maier, Baar (CH)

(73) Assignee: TEQTONIQ GmbH, Horw (CH)

( * ) Notice: Subject to any disclaimer, the term of this patent is extended or adjusted under 35 U.S.C. 154(b) by 0 days.

(21) Appl. No.: 17/047,214

(22) PCT Filed: Apr. 2, 2019

(86) PCT No.: PCT/EP2019/058234
§ 371 (c)(1),
(2) Date: Oct. 13, 2020

(87) PCT Pub. No.: WO2019/197207
PCT Pub. Date: Oct. 17, 2019

(65) Prior Publication Data

US 2021/0164483 A1 Jun. 3, 2021

(30) Foreign Application Priority Data

Apr. 13, 2018 (DE) ..... 10 2018 108 828.0

(51) Int. Cl.
*F04D 29/056* (2006.01)
*F04D 29/42* (2006.01)

(52) U.S. Cl.
CPC ..... *F04D 29/056* (2013.01); *F04D 29/4206* (2013.01)

(58) Field of Classification Search
None
See application file for complete search history.

(56) References Cited

U.S. PATENT DOCUMENTS 3,960,468 A * 6/1976 Boorse ..... F04D 13/0613 417/423.13
4,764,085 A * 8/1988 Jesinger ..... F04D 29/057 310/90.5

(Continued)

FOREIGN PATENT DOCUMENTS

DE 360124 A1 7/1987
DE 102010001538 8/2011

(Continued)

OTHER PUBLICATIONS

International Search Report and translation for corresponding International Patent Application No. PCT/EP2019/058234 dated Jul. 5, 2019.

*Primary Examiner* — Michael Lebentritt
(74) *Attorney, Agent, or Firm* — Renner, Otto, Boisselle & Sklar, LLP

(57) ABSTRACT

A radial blower, in particular for a cooling machine, comprising a housing in which a shaft is rotationally mounted, which receives at least one impeller wheel of a compressor at one end, which is secured to the housing, comprising at least one radial bearing and at least one axial bearing via which the shaft is rotationally mounted in the housing, and comprising a motor driven by a rotor and a stator and provided between the first and the second radial bearing, wherein at least one channel having a pressure connection for a pressure medium to be supplied is provided in the housing, which channel feeds into a rotor space formed between the shaft and the housing and extending from the impeller wheel to the radial bearing or axial bearing, which is provided next to the impeller wheel.

7 Claims, 3 Drawing Sheets

(56) References Cited

U.S. PATENT DOCUMENTS

| | | | | |
|---|---|---|---|---|
| 5,885,057 | A * | 3/1999 | Wootten | F03B 3/12 415/73 |
| 9,732,766 | B2 * | 8/2017 | Thompson | F04D 17/125 |
| 2016/0281744 | A1 * | 9/2016 | Ohta | F04D 17/16 |
| 2016/0365770 | A1 * | 12/2016 | Nelson | H02K 5/20 |
| 2018/0179849 | A1 * | 6/2018 | Krishnan | E21B 41/0085 |
| 2018/0179872 | A1 * | 6/2018 | Filatov | F04D 25/0686 |

FOREIGN PATENT DOCUMENTS

| | | | |
|---|---|---|---|
| DE | 10201721960 | A1 | 1/2019 |
| JP | 2001123997 | | 5/2001 |
| KR | 101847165 | | 4/2018 |

* cited by examiner

RADIAL BLOWER

RELATED APPLICATION DATA

This application is a national phase of International Application No. PCT/EP2019/058234 filed Apr. 2, 2019, which claims priority to German Patent Application No. 10 2018 108 828.0 filed on Apr. 13, 2018, all of which are hereby incorporated herein by reference.

FIELD OF THE INVENTION

The invention relates to a radial blower for a cooling device, wherein the radial blower comprises an engine housing in which a shaft is rotatably mounted which, on one end, receives at least one impeller of a compressor which is fixed on the engine housing, and having at least one radial bearing having at least one axial gas bearing by means of which the shaft is rotatably mounted in the housing.

BACKGROUND

A radial blower for a gas laser is known from DE 10 2010 001 538 A1. Between a first and a second radial bearing, in particular radial gas bearing, this radial blower comprises an engine that is formed by a rotor and a stator. The axial gas bearing is provided opposite the impeller on a shaft, i.e. the engine and the radial gas bearings respectively arranged adjacently to the engine are provided between the axial gas bearing and the impeller. Under pressure, a gas is supplied to each of these radial gas bearings and the axial gas bearing, such that the shaft is mounted to the housing without wear and without servicing.

SUMMARY OF THE INVENTION

The object of the invention is to propose a radial blower for a cooling machine which makes a simple construction and a safe operation possible.

This object is solved by a radial blower in which at least one channel is provided with a port for a pressure medium, which opens out into a rotor chamber which extends between the impeller and the radial bearing adjacent to this or axial gas bearing. The rotor chamber in the engine housing of the radial blower is attached to a gas chamber of the compressor arranged on the engine housing. As a result of this arrangement, a seal between the engine housing receiving the shaft and the engine and the compressor is made possible without using an additional radial shaft sealing or labyrinth sealing. In addition, this sealing arrangement has the advantage that a pressure level in the engine housing of the radial blower can be kept low, whereby a condensation of a coolant for operating a cooling machine is prevented, and a safe operation of the radial bearing and/or axial gas bearing is ensured.

Preferably, the axial gas bearing is positioned between a radial bearing allocated to the engine and the impeller. Preferably, the radial bearing is formed as a radial gas bearing. Thus, in particular the supply of the pressure medium into the engine housing to operate the axial gas bearing seals the outside of the housing to the compressor. As the result of such an axial gas bearing, a kind of labyrinth sealing can be emulated. Advantageously, a gas chamber of a second stage of the compressor is sealed against the adjacent rotor chamber of the engine housing.

Furthermore, the channel in the engine housing preferably leads directly into the rotor chamber and is connected to the gas chamber of the compressor pointing towards the impeller, wherein, pointing in the direction of the axial gas bearing, the rotor chamber is also connected to a working gap between an axial stator and a plate of the axial gas bearing. This makes a simple yet compact constructive arrangement possible, whereby on one hand there is a sealing arrangement and on the other hand a wear-free, contactless and servicing-free operation of the axial gas bearing.

Furthermore, the at least one axial gas bearing and the radial bearing arranged adjacently thereto are preferably connected by means of a common rotor chamber. Thus, a pressure compensation in the engine housing can be made possible using the radial bearing.

Furthermore, a heating device is preferably provided abutting on the axial gas bearing or adjacently to the axial gas bearing. Thus, a condensation of a gas or a coolant on an effective surface of the axial and/or radial gas bearing can be counteracted. Preferably, such a heating device is operated with a temperature at which the axial and/or radial gas bearing is heated to a temperature which is above a dew point of the gas or the coolant at the prevailing pressure.

Furthermore, the engine housing of the radial blower with the compressor arranged thereon is preferably aligned vertically in an operating state. A so-called vertical operation is preferably provided. Here, the compressor in particular is aligned pointing downwards and the engine housing pointing upwards. This alignment of the engine housing in a vertical operation moreover has the advantage that a condensate formation can be reduced or prevented, or, in the event of condensate formation when the system stops, the condensate flows out downwards.

BRIEF DESCRIPTION OF THE DRAWINGS

The invention and further advantageous embodiments and developments thereof are described and explained in more detail below by means of the examples depicted in the drawings. The features that can be seen in the description and the drawings can be applied according to the invention individually or together in any combination. Here are shown.

DETAILED DESCRIPTION

Figure 1:
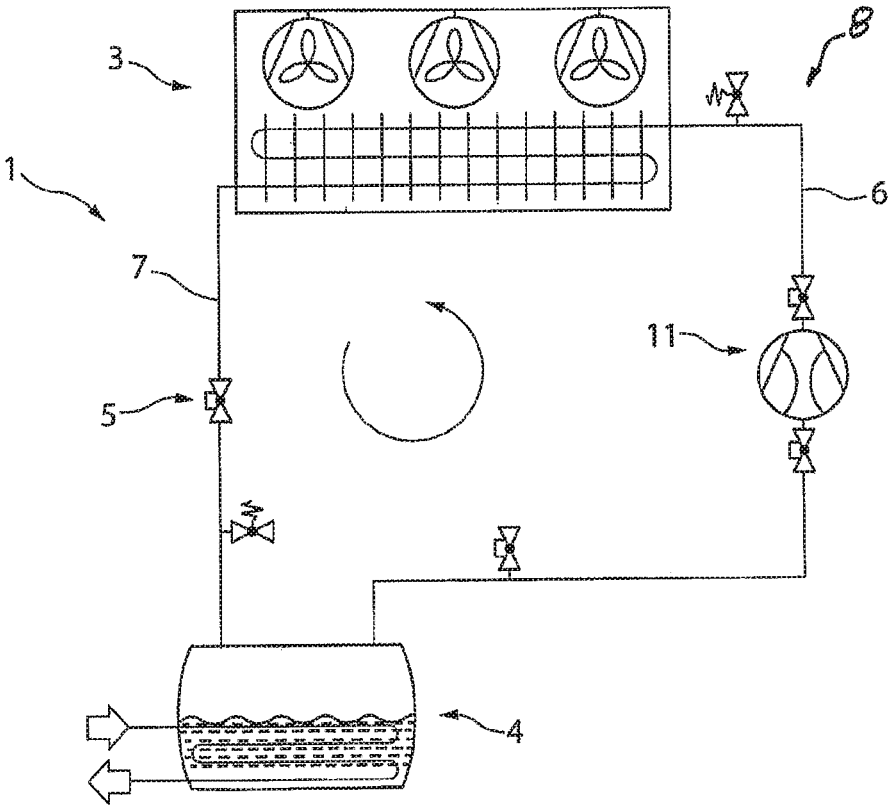
FIG. 1 a schematic view of a cooling machine.

A cooling machine is depicted in FIG. 1. A cooling medium is moved therein in a closed circuit and transferred in sequence into different aggregate states. The gaseous cooling medium is firstly compressed by a radial blower 11 and led into a compression side 8 of the cooling machine 1 by a gas pressure line 6. In a condenser 3, the cooling medium condenses by emitting heat. The liquid cooling medium is guided to a throttle 5 by means of a liquid pressure line 7 and released there. In the attached evaporator 4, the cooling medium expands (evaporates) by heat absorption at a low temperature. The evaporator 4 can here be advantageously designed as a flooded evaporator 4.

Figure 2:
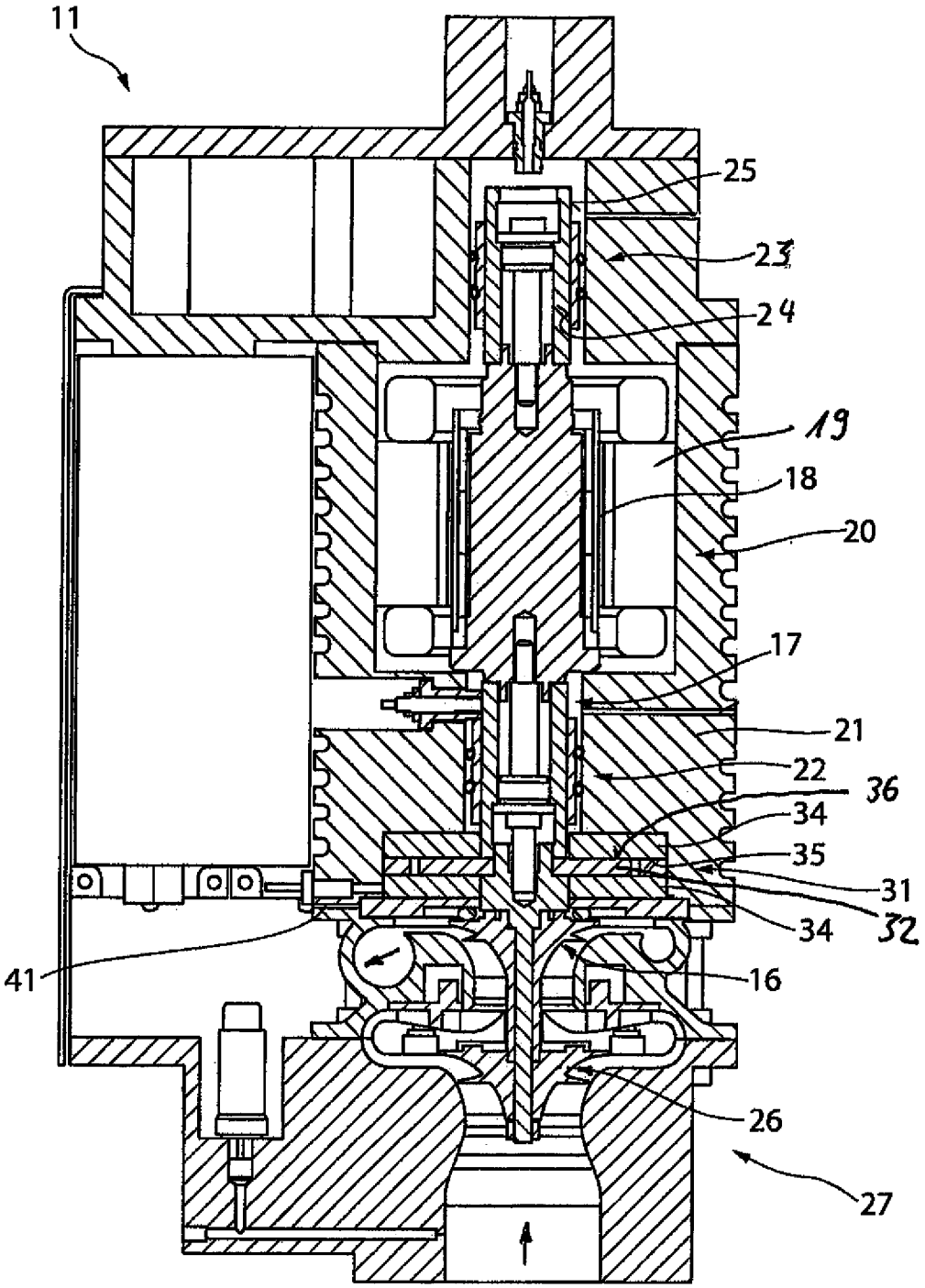
FIG. 2 a radial blower according to the invention for a cooling machine according to FIG. 1, and FIG. 3 a schematically enlarged view of the axial gas bearing and the connection of the compressor to the engine housing of the radial blower.

The radial blower 11 is depicted in a longitudinal section in FIG. 2. By means of this radial blower 11, the cooling medium is radially accelerated by at least one impeller 16, 26 of a compressor 27, in particular a turbo radial compressor, and guided into the gas pressure line 6 of the compression side 8 of the cooling machine 1 in a compressed manner. The impeller 16, 26 rests on a shaft 17 which is driven by an engine 20 in the central region of the engine housing 21. This engine consists of a rotor 18 connected to the shaft 17 and a stator 19 fixed on the engine housing 21. The region, which is arranged outside the impeller 16, 26 when seen from the shaft 17, forms the pressure side of the blower. In the upper and lower region of the shaft 17, in each case a radial bearing, in particular a lower radial gas bearing 22 and an upper radial gas bearing 23, are arranged. These radial gas bearings 22 comprise stationary bearing surfaces, which are referred to as radial stators 24. Furthermore, the shaft comprises rotating bearing surfaces 25 in the region of the radial gas bearings 22, 23. The pressure medium for the gas bearings is advantageously the cooling medium.

An axial gas bearing 31 is provided between the impeller 16 of the compressor 27 and the lower radial gas bearing 22. This axial gas bearing 31 comprises a rotating plate 32 and, adjacently to the plate 32 or on its upper side and lower side, axial stators 34, which each have stationary bearing surfaces 35. The plate 32 comprises rotating bearing surfaces 36, which lie opposite the stationary bearing surface 35. A channel 41, which is connected to the compression side 8 of the cooling machine 1, leads below the impeller 16 between the axial gas bearing 31 and impeller 16. The pressurised cooling medium is guided below the impeller 16 through this channel 41 in a gaseous state, in order to protect the axial gas bearing 31 from the ingress of particles.

The rotating bearing surfaces 25 of the radial gas bearing 22 and/or the rotating bearing surfaces 36 of the axial gas bearing 31 preferably have surfaces which comprise grooves. Fishbone patterns are preferably provided. Such grooves or surface indentations are preferably introduced with an ultra-short pulsed laser, in particular picosecond laser. This enables a processing with very short processing times. Moreover, this processing step does not require reworking and meets the high demands of the precise design. The very short laser impulses in the microsecond range lead to a direct sublimation of the material. Thus, a production of these grooves can be provided which does not require reworking, in particular is free from burrs. In particular, an ion beam method is used. Alternatively, a micro-machining can also be provided.

In an installation situation, the radial blower 11 is aligned vertically in the cooling machine. Here, the compressor 27 is aligned downwards, and the engine housing 21 is aligned vertically upwards. The radial blower 11 can advantageously be arranged directly above a flooded evaporator 4, such that, where necessary, condensate emerging when the cooling machine 1 is at a standstill flows downwards back into the evaporator 4.

Figure 3:
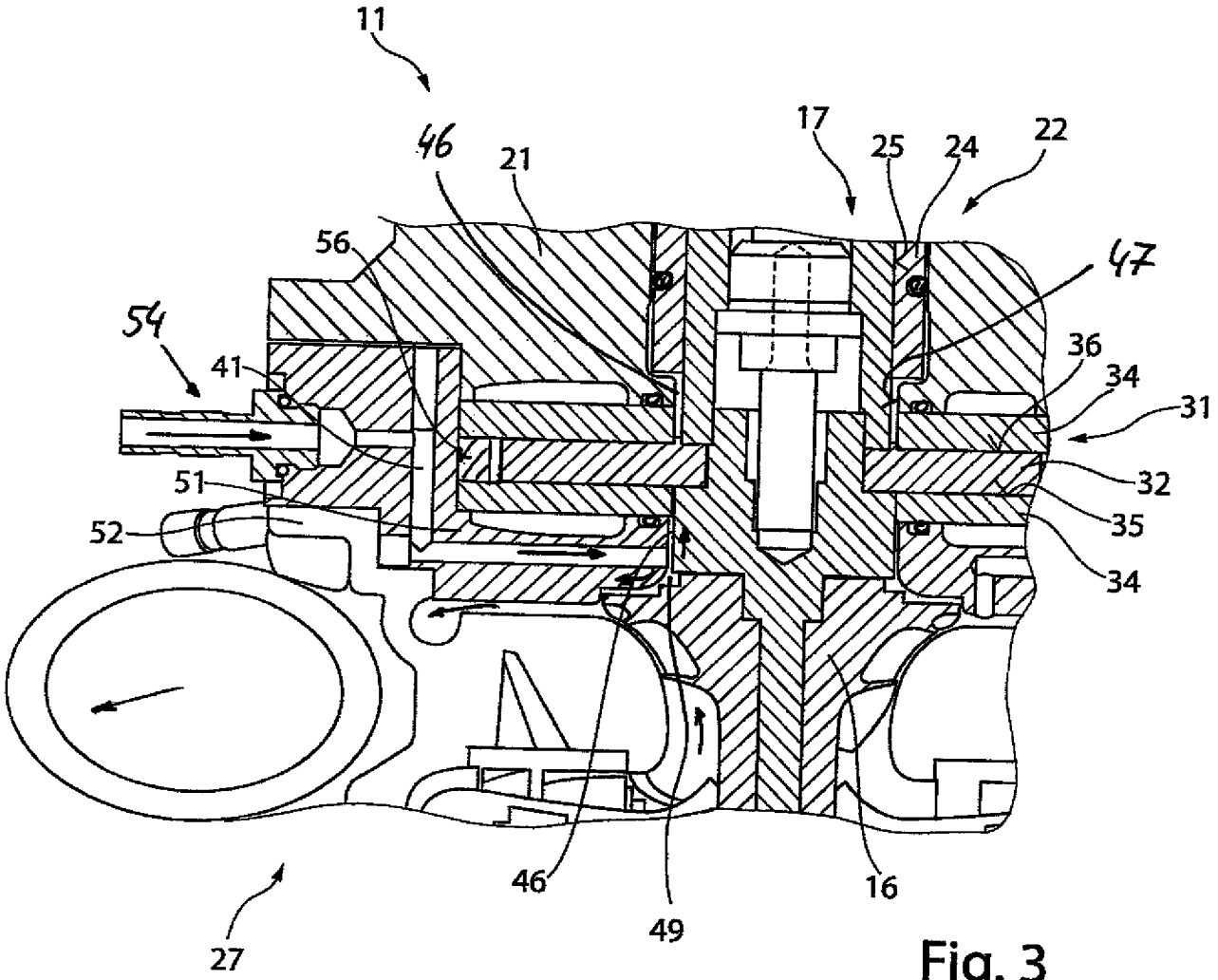

In FIG. 3, a schematically enlarged view of the axial gas bearing 31 and a connection of the compressor 27 to the engine housing 21 of the radial blower 11 is depicted. The connection of the compressor 27 with its housing 52 to the engine housing 21 of the radial blower 11 is carried out without using a labyrinth sealing or similar. The supply of the pressurised cooling medium via the channel 41 is used to prevent an ingress of particles into the axial gas bearing 31. The axial gas bearing 31 itself has such a narrow gap between the bearing surfaces 35 of the stator 34 and the bearing surfaces 36 of the rotating plate 32 that a seal between a rotor chamber 46 in the housing 21 and a gas chamber 49 in the compressor 27 is formed by the axial gas bearing 31 itself. Seen in the radial direction, the rotor chamber 46 is formed between a through-hole 47 in the engine housing 21 and the shaft 17 mounted therein. The gas chamber 49 is formed between a housing portion 51 of the engine housing 21 or housing 52 of the compressor 27 and the impeller 16. A housing 52 of the compressor 27 preferably engages around the housing portion 51 and is fixedly connected to the engine housing 21 outside of this housing portion 51.

A pressure port 54 for the pressurised cooling medium is provided on the engine housing 21, which is supplied to the channel 41. In a region in which the rotor chamber 46 and the gas chamber 49 are adjacent to each other, the cooling medium flows mainly in the direction of the gas chamber 49; the gas flow is held off through the axial bearing 31 in the counter-direction, which seals the rotor chamber 46.

A seal between a pressure side of the compressor 27 and the engine housing 21 is carried out as a result of this arrangement. The compressor 27 is preferably formed as a multi-step compressor or turbo compressor. A first step forms the impeller 26, and the second step forms the impeller 16. In particular, the seal between the pressure side of the second step or the impeller 16 of the compressor 27 and the engine housing 21 of the radial blower 11 can be carried out. In this way, a lower pressure can be set in the engine housing than on the pressure side of the compressor 27, whereby a condensation of the cooling medium in the radial bearings 22, 23 is prevented.

Furthermore, the pressure port 54 can preferably have a filter element. This ensures that no particles reach the compressor 27 and/or the axial gas bearing 31.

This radial blower 11 can furthermore have a heating device 56 in the region of the axial gas bearing 31 or adjacent to an axial stator 34 or between the two axial stators 34. Such a heating device 56 serves to heat the axial gas bearing 31 to a temperature which is above the dew point of the cooling medium at an acting pressure. Thus, a condensation of the cooling medium can be prevented. Such a heating device 56 can be formed as an electrically driven heater, such as by a resistance heating element or a PTC element, for example.

The invention claimed is:

1. A radial blower for a cooling machine, comprising:

a housing, in which a shaft is rotatably mounted, which, on one end, receives at least one impeller of a compressor which is fixed on the housing, at least two radial bearings including first and second radial bearings, and having at least one axial gas bearing by means of which the shaft is rotatably mounted in the housing, and an engine driven by a rotor and stator, which is provided between the first and the second radial bearing, and wherein in the housing, at least one channel is provided with a pressure port for a pressure medium to be supplied, which opens out into a rotor chamber, which is formed between the shaft and the housing, and the rotor chamber extends from the impeller to the axial gas bearing, which is provided adjacently to the impeller, and wherein the channel provided between the impeller and the axial gas bearing in the housing leads into the rotor chamber in the housing and a gas chamber of the compressor, wherein the rotor chamber is connected to a working gap between an axial stator and a plate of the axial gas bearing, and the axial bearing sealingly borders the rotor chamber.

2. The radial blower according to claim 1, wherein the axial gas bearing is positioned between a radial bearing allocated to the engine and the impeller.

3. The radial blower according to claim 1, wherein the at least one radial bearing is formed as a radial gas bearing, and the at least one radial gas bearing is connected to the adjacent axial gas bearing by means of the common rotor chamber.

4. The radial blower according to claim 1, wherein a heating device is provided abutting on the axial gas bearing or adjacently to the axial gas bearing.

5. The radial blower according to claim 1, wherein in an operating state, the housing with the compressor arranged thereon is aligned vertically, wherein the compressor is aligned downwardly and the housing upwardly.

6. A radial blower for a cooling machine, comprising:

a housing, in which a shaft is rotatably mounted, which, on one end, receives at least one impeller of a compressor which is fixed on the housing, at least two radial bearings including first and second radial bearings, and having at least one axial gas bearing by means of which the shaft is rotatably mounted in the housing, and an engine driven by a rotor and stator, which is provided between the first and the second radial bearing, wherein in the housing, at least one channel is provided with a pressure port for a pressure medium to be supplied, which opens out into a rotor chamber, which is formed between the shaft and the housing, and the rotor chamber extends from the impeller to the axial gas bearing, which is provided adjacently to the impeller, and wherein a heating device is provided abutting on the axial gas bearing or adjacently to the axial gas bearing.

7. A radial blower for a cooling machine, comprising:

a housing, in which a shaft is rotatably mounted, which, on one end, receives at least one impeller of a compressor which is fixed on the housing, at least two radial bearings including first and second radial bearings, and having at least one axial gas bearing by means of which the shaft is rotatably mounted in the housing, and an engine driven by a rotor and stator, which is provided between the first and the second radial bearing, wherein in the housing, at least one channel is provided with a pressure port for a pressure medium to be supplied, which opens out into a rotor chamber, which is formed between the shaft and the housing, and the rotor chamber extends from the impeller to the axial gas bearing, which is provided adjacently to the impeller, and wherein in an operating state, the housing with the compressor arranged thereon is aligned vertically, wherein the compressor is aligned downwardly and the housing upwardly.

* * * * *